US006993941B2

(12) United States Patent
Yamaguchi

(10) Patent No.: US 6,993,941 B2
(45) Date of Patent: Feb. 7, 2006

(54) SILVER-KNIT MATERIAL

(75) Inventor: Tosirou Yamaguchi, Osaka (JP)

(73) Assignee: Kuraray Co., Ltd., Kurashiki (JP)

( * ) Notice: Subject to any disclaimer, the term of this patent is extended or adjusted under 35 U.S.C. 154(b) by 0 days.

(21) Appl. No.: 10/958,289

(22) Filed: Oct. 6, 2004

(65) Prior Publication Data

US 2005/0109069 A1 May 26, 2005

(30) Foreign Application Priority Data

Oct. 8, 2003 (JP) ..... 2003-349131

(51) Int. Cl.
*D04B 11/08* (2006.01)

(52) U.S. Cl. ..... 66/202; 442/304

(58) Field of Classification Search ..... 66/190, 66/191, 192, 193, 194, 202; 442/312, 313, 442/304

See application file for complete search history.

(56) References Cited

U.S. PATENT DOCUMENTS

| | | | | |
|---|---|---|---|---|
| 3,732,135 | A * | 5/1973 | Ernst et al. | 156/72 |
| 4,415,611 | A * | 11/1983 | Yamagata et al. | 28/160 |
| 4,466,151 | A * | 8/1984 | Barch et al. | 15/229.13 |
| 4,546,020 | A * | 10/1985 | Sakai et al. | 428/16 |
| 4,798,748 | A * | 1/1989 | Kitamura et al. | 428/15 |
| 6,766,668 | B2 * | 7/2004 | Sinykin | 66/191 |

FOREIGN PATENT DOCUMENTS

| | | |
|---|---|---|
| JP | 2-4679 | 1/1990 |
| JP | 2002-302863 | 10/2002 |

* cited by examiner

*Primary Examiner*—Danny Worrell
(74) *Attorney, Agent, or Firm*—Oblon, Spivak, McClelland, Maier & Neustadt, P.C.

(57) ABSTRACT

A sliver-knit material causing less buckling fatigue or deformation during compression and improved with shedding, in which a pile thread contains 30% or more of staple fibers having steric crimps, and a dense layer (Bo) and a bulky layer (Su) on the side of the upper layer in contact with the dense layer (Bo) are formed, where the ratio of height between the dense layer (Bo) and the bulky layer (Su) in the sliver-knit material is from 2:5 to 1:1, and at least a portion of fibers present in the dense layer (Bo) are folded back.

18 Claims, 3 Drawing Sheets

SILVER-KNIT MATERIAL

BACKGROUND OF THE INVENTION

1. Field of the Invention

The present invention relates to a sliver-knit material and, more specifically, it relates to a sliver-knit material which causes less buckling fatigue or deformation during compression, and has improved shedding properties. The sliver-knit material of the invention is suitable, particularly, as a skin material for paint rollers. The present invention also relates to a sliver-knit material which does not cause boundary line failure during production of paint rollers, and which has excellent holdability (liquid absorbability) and paint releasability (coatability), particularly, to thick coatings, as well as to a paint roller composed of this sliver-knit material.

2. Description of the Background

Heretofore, pile materials include those-prepared by planting or weaving pile fibers into a woven or knitted substrate fabric, which is used in various applications such as floor coverings. However, the pile materials have the drawback of causing stress concentration for external loads and suffer from buckling fatigue or shedding of pile threads.

On the other hand, in the paint roller application, fabrics containing synthetic fibers or pure wools and sponges and having coatings are used. Among them, sliver-knit materials using synthetic fibers, which are less expensive, have been used generally.

However, in the sliver-knit material described above, not all pile threads are secured to the base threads. Rather, many fibers free from the base threads and entangling with each other (hereinafter referred to as sheds) are present. One known drawback is that the sheds are detached due to the viscosity of coatings during coating operation and adhered to the coated surface (this is referred to as "shedding").

Accordingly, for preventing shedding from the sliver-knit material, an operation of coating and impregnating a resin on the bottom side of a base material thereby fixing pile threads held by base threads and, further, brushing the piled surface of the sliver-knit material for removing sheds as much as possible has been applied. However, the applicability of such an operation is extremely limited.

Japanese Unexamined Utility Model Publication No. Hei 2-4679 proposes a roller-shaped brush using a base material incorporated with at least 10% or more of low melting point composite fibers in order to prevent detachment of sheds and forming fused portions with the low melting point composite fibers by using a suction type heat treating machine.

However, the sheds can not be suppressed completely by merely mixing a small amount of the low melting point composite fibers. Suppression of sheds was substantially impossible unless the low melting point composite fibers were used in a great amount in view of the mechanism in the production of the sliver-knit material.

When the low melting point composite fibers are used in a large amount, an improvement can be obtained to some extent for the detachment of sheds. However, since the base material itself is hardened, it cannot be wound around the core of a roller. Even when it can be wound around, boundary lines are formed to cause roller marks on the coated surface, failing to obtain a paint roller of high commercial value.

In addition, since the base material itself is hardened, gaps are formed on the piled surface to give a serious problem that no uniform piled surface can be formed.

Actually, Japanese Unexamined Utility Model Publication No. Hei 2-4679 describes a manufacturing method involving the use of a suction type heat treatment machine. However, since a hot blow penetrates the piled surface, fusion with the low melting point composite fibers is caused remarkably as far as the pile surface, the surface is also hardened to leave the problem that the boundary lines become conspicuous during production of paint rollers as described above.

Furthermore, the brushing process during production of paint roller is configured for masking the boundary lines. However, the effect of the suppression of sheds is undetermined by the application of the mentioned above, which break down the fusion with the low melting point composite fibers.

On the other hand, Japanese Unexamined Patent Publication No. 2002-302863 proposes a fiber structure for use in a coating tool, containing from 30 to 100 mass % of heat fusible fibers and having a reticular fused layer and a bulky layer with an aim of improving the coatability of a low viscosity fluid typically represented by photo-catalyst coatings containing, for example, an anatase titanium dioxide grade.

However, while the fiber structure described above can suppress shedding, it is recognized that the structure lacks in the basic performance as a paint roller of sufficiently holding and releasing thick coatings. This is because crimps appear frequently to fibers used in the fiber structure (large number of crimps) and, accordingly, fused portions are formed excessively in the reticular fused layer to lack in the flexibility.

In recent years, in view of the consideration for the environment, solvent type coatings have been changed to environmentally-friendly coatings such as water borne coatings. Accordingly, the viscosity of the coatings has increased significantly. In the paint roller using the existent sliver-knit material, the shedding described above has a serious problem.

Further, since thick coatings have a quick-drying property, there is a problem that the coatings are cured in the structure in a paint roller of poor circulation of coating. Then, the fiber structure described above causes a problem that the coatings are cured in the reticular fused layer.

Accordingly, since the coatings can be held actually only in the bulky layer, the content of the coatings is small thereby limiting coatability.

As described above, in the paint roller made of the sliver-knit material, it is a problem to suppress shedding while keeping the basic performance of a paint roller of sufficiently holding and releasing thick coatings. However, a paint roller capable of satisfying such performance requirements simultaneously has not yet been provided.

SUMMARY OF THE INVENTION

It is an object of the present invention to provide a sliver-knit material which causes less buckling fatigue or deformation during compression and has improved shedding properties. Further, the invention provides a sliver-knit material suitable for paint rollers also capable of coping with the change in the nature of coatings in recent years. Furthermore, the present invention also provides a paint roller which does not suffer from boundary line failure during production and does not hinder the bulkiness at the surface while maintaining the paint holdability and the paint releasability as the basic performance of the paint roller.

For attaining the foregoing objects, the present inventors have made earnest studies. As a result, the present inventors have produced a sliver-knit material which causes less shedding and is capable of satisfying the paint holdability and the paint releasability properties discussed above, especially for thick coatings, by incorporating 30 mass % or more of staple fibers having steric crimps and forming a dense layer (Bo) and a bulky layer (Su) on the upper layer adjacent with the dense layer (Bo) in the pile material.

Thus, the invention provides a sliver-knit material in which a pile thread contains 30 mass % or more of staple fibers having steric crimps, and a dense layer (Bo) and a bulky layer (Su) on the upper side in adjacent with the dense layer (Bo) are formed, and in which the ratio of height between the dense layer (Bo) and the bulky layer (Su) in the sliver-knit material is from 2:5 to 1:1, and at least a portion of fibers present in the dense layer (Bo) are folded back.

According to the invention, it is possible to obtain a sliver-knit material capable of remarkably suppressing shedding and suffering less from buckling fatigue or deformation during compression. Further, the sliver-knit material according to the invention is particularly suitable for paint rollers and can provide a sliver-knit material with no occurrence of failed products caused by boundary lines during production of paint rollers and which also has favorable paint holdability and paint releasability properties. Further, the invention can provide a paint roller having excellent paint holdability and paint releasability even for thick coatings, such as environmentally friendly coatings.

The present invention also provides a method of producing the sliver-knit material described above, comprising:

providing a sliver containing staple fibers having steric crimps at a ratio of 30 mass % or more as pile threads to produce a base, aligning the fibers at the desired pile height, and subjecting the backside of the base to a backing treatment.

The present invention also provides a method of painting, comprising applying paint to the sliver-knit material as described above and then transferring the paint from the sliver-knit material to a surface.

BRIEF DESCRIPTION OF THE DRAWINGS

Preferred embodiments of the present invention will be described in details based on the drawings, wherein.

DETAILED DESCRIPTION OF THE INVENTION

The sliver-knit material according to the invention contains 30 mass % or more of staple fibers having steric crimps, preferably in which fused portions between each of the fibers constituting the pile threads are not present. Then, the invention includes a sliver-knit material of a bilayer structure in which a dense layer (Bo) and a bulky layer (Su) on the side of the upper layer adjacent with the bulky layer (Bo) are formed and in which the ratio of height between the dense layer (Bo) and the bulky layer (Su) in the sliver-knit material is from 2:5 to 1:1.

That is, the sliver-knit material according to the invention has a feature in preventing the detachment of sheds without developing the thermal fusing function even when using heat fusible fibers as constituent fibers and provides the effect capable of including sheds in the dense layer (Bo) and not adhering sheds to the coated surface even when coating operation is conducted while incorporating coatings in the sliver-knit material, by forming a bilayer structure comprising a dense layer (Bo) and a bulky layer (Su) present near the side of the surface of the dense layer (Bo).

Figure 1:
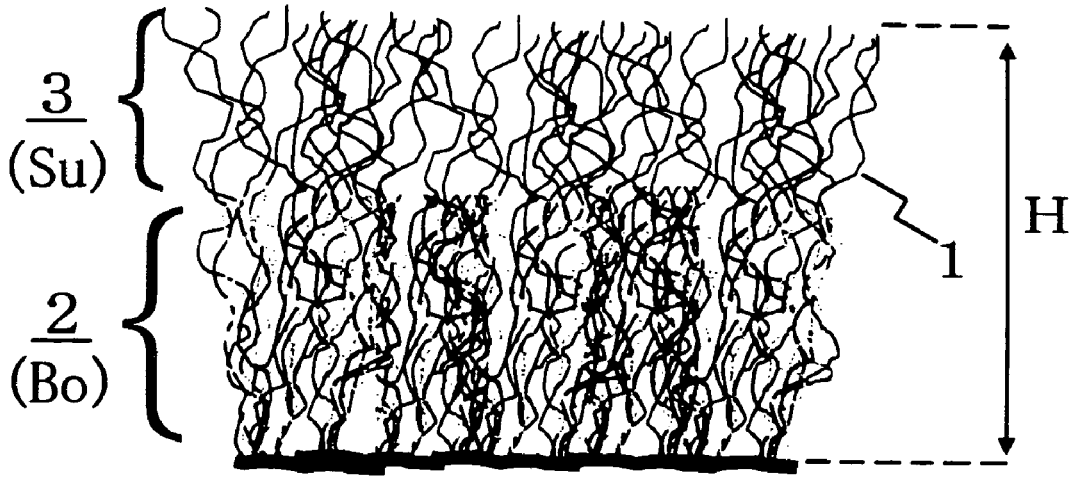
FIG. 1 is a schematic cross sectional view showing an example of a sliver-knit material according to the invention.

The bilayer structure referred to in the invention means a structure formed with a layer of higher fiber density and a layer of lower fiber density in the schematic cross sectional view of the sliver-knit material according to the invention shown in FIG. 1. The figure shows both of the layers, namely, a layer of higher fiber density, that is, the dense layer (Bo) in which fibers constituting pile threads are present densely, and a layer of lower fiber density on the upper side (surface) thereof, that is, a bulky layer (Su) in which pile threads are present less densely compared with the dense layer.

The pile height for the sliver-knit material of the invention is set preferably to 10 to 18 mm, more preferably, 13 to 18 mm and, further preferably, 13 to 16 mm. In a case where the pile height is less than 10 mm, staple fibers present in the dense layer (Bo) may be extended during coating to sometimes form traces like those formed after sweeping by a broom on the coated surface. On the other hand, when the pile height exceeds 18 mm, sheds of the bulky layer (Su) present in the layer upper than the dense layer (Bo) cannot be suppressed, making it difficult to control shedding.

Here, the pile height means a height from the base (ground portion) to the top end of the pile thread, which corresponds to the total height of the dense layer (Bo) and the bulky layer (Su).

It is noted that "height from the base" referred to in the invention means a distance from the counter setting side of the loops of the base thread that retain the pile threads when the base material is set horizontally. More specifically, the pile height means the dimension shown by H in FIG. 1.

Further, the dense layer (Bo) of the sliver-knit material of the invention has a height from the base, preferably, of 5 to 9 mm.

While the formation of the dense layer (Bo) is described below, in a case where the height of the dense layer (Bo) from the base is less than 5 mm, it is necessary to set the cut length of the staple fiber having a steric crimp to 38 mm or less, or set the number of crimps to an extremely higher level, and sheds tend to be formed in each of the cases.

On the other hand, in a case where the height of the dense layer (Bo) from the base exceeds 9 mm, detachment of sheds can not sometimes be prevented. That is, since disconnection of pile threads is caused during the polishing operation in the formation of the dense layer (Bo) to be described later, it increases sheds. Further, as the height (thickness) of the dense layer increases, winding around the paint roller core becomes difficult, which makes boundary lines conspicuous. This results in a failure to obtain the desired product.

With a view point of preventing shedding caused by sheds more effectively, the height of the dense layer (Bo) from the base is preferably from 7 to 8 mm.

Further, when the height of the bulky layer (Su) exceeds the height of the dense layer (Bo) by 11 mm, since sheds cut in the polishing operation remain in the bulky layer (Su), they become attached to the coated surface as fluffs during coating operation. Accordingly, the height difference between the bulky layer (Su) and the dense layer (Bo) is preferably 11 mm or less.

In the sliver-knit material of the invention, in order to form the bilayer structure described above, it is important to incorporate 30 mass % or more of staple fibers having steric crimps in the pile threads. In a case where the content of the staple fibers is less than 30 mass %, the bilayer structure cannot be formed. The staple fibers are incorporated, preferably, by 50 mass % or more and, further preferably, 70 mass % or more.

Although the fineness of the staple fibers having steric crimps used in the invention may be set properly depending on the purpose for suppressing disconnection which may possibly occur during fabrication step for the sliver-knit material, it is preferably at least 3 dtex or more and, more preferably, from 3 to 9 dtex. Further, the fiber length is preferably from 38 to 131 mm and, more preferably, from 44 to 76 mm.

For the staple fibers, fibers of an identical fineness may be used alone, or staple fibers of different fineness may be used as a mixture.

The staple fibers used in the invention are staple fibers having coiled steric crimps developed from side-by-side type composite fibers, eccentric core/sheath type composite fibers or asymmetrically cooled fibers. In a case of planer crimped zig-zag fibers, the purpose of the invention cannot be attained since the fibers are less entangled with each other.

As staple fibers forming the steric crimps usable in the invention, core/sheath type, or side-by-side type composite fibers are preferred. In the case of the core/sheath type fibers, an eccentric core/sheath type is more preferred and the number of crimps of 8 to 20 N/25 mm is preferred in view of forming the dense layer (Bo) by a polishing operation.

In a case where the number of crimps exceeds 20 N/25 mm, the height of the dense layer (Bo) tends to be lowered and, at the same time, sheds entangled in the bulky layer (Su) increase and tend to be detached. On the other hand, in a case where the number of crimps is less than 8 N/25 mm, the dense layer (Bo) tends to become indistinct.

It is important for the staple fibers present in the dense layer (Bo) of the sliver-knit material according to the invention that they are present by being folded back at least partially. By the presence of the folded back portion, a clear boundary is present between the dense layer (Bo) and the bulky layer (Su). The reason why such folded back portions are formed is not apparent but it may be estimated that such a state is caused by setting the polishing operation during the finishing step to the base incorporating 30 mass % or more of staple fibers having steric crimps like coiling crimps.

Further, as a result of formation of the structure described above, the mass of the fibers in the dense layer (Bo) is sometimes larger than the mass of fibers in the bulky layer (Su).

Further, the difference in the number of crimps between the folded back staple fibers present in the dense layer (Bo) and the staple fibers present in the bulky layer (Su) is scarcely recognized. When the folded back state is released and the fibers are erected so as not to extend crimps, those having the fiber length longer than the height of the pile are present. Specifically, the height of the folded back fibers present in the dense layer, when they are erected substantially vertically so as not to extend the crimps, is about 1.1 to 1.6 times that of the dense layer (Bo).

As the polymer constituting the staple fibers, various combinations of polymers can be used. For example, in a case of polyester polymers, they include a combination of polyethylene terephthalate (PET) having different polymerization degrees (difference in the intrinsic viscosity) to each other, a combination of PET and co-polyester (Co-PET), a combination of PET and polypropylene terephthalate (PPT), a combination of PET and a co-polybutylene terephthalate (Co-PBT), a combination of aliphatic polyesters, a combination of PET and other modified PET and, further a combination of PET and an ethylene-vinyl alcohol copolymer.

In a case of using fibers not having a distinct melting point and having a nature of softening and melting broadly, the mixing ratio is preferably 30 mass % or less.

Further, in a case of using heat fusible fibers containing at least a portion of the fibers constituting the polymer is melted and softened upon heat treatment, it is preferred to fabricate them under the condition that they are not melted and softened to prevent the fibers from fusing each other at a heat setting temperature conducted for the improvement of the dimensional stability of the sliver-knit material or backing to the rearface. In the invention, it is preferred that there occur substantially no fused portions between the fibers in the pile threads constituting the sliver-knit material, but fibers may be fused to each other to such an extent as not deteriorating the softness and flexibility of the fibers. In a case where the softness and flexibility are lost, the releasing amount for the thick coatings is remarkably lower.

As has been described above, the sliver-knit material according to the invention is capable of suppressing sheds even in a case where portions formed by fusing of fibers to each other are not substantially present and, further, has a feature of excellent softness and flexibility and coatability.

In the invention, "portions formed by fusing of fibers to each other are not substantially present" means a state that even when heat fusible fibers are mixed and the fusible fibers are melted and softened to form fused portions in the heat treatment step, the fused portions are localized to a portion in the region of the dense layer (Bo), and no fused portions are formed in the bulky layer (Su). That is, not all the mixed fusible fibers are melted and softened to form fused portions.

Even if the fused portions are formed in the bulky layer (Su), brushing for masking the boundary lines break down the fusion with the low melting point composite fiber. So that means no effect of the suppression of sheds.

Further, as the fibers other than the staple fibers described above, various synthetic fibers and natural fibers can be used and, as described below, it is preferred to use those fibers with the fineness finer than that of the staple fibers.

A method of producing the sliver-knit material according to the invention is described below.

For the sliver-knit material according to the invention, a sliver containing staple fibers having steric crimps at a ratio of 30 mass % or more are supplied as pile threads to produce a base.

Usually, in the fabrication step for the sliver-knit material, a polishing operation is applied so as to clear off excess of fibers on the surface of the base. Since the operation is also for removing sheds to some extent in addition to the purpose described above, a blade for the polishing is inserted near the basal of the base.

In a case where the stuffing constituting the base are staple fibers comprising mechanical crimping, polishing exerts so as to extend the crimps of the fibers. However, in a case of using staple fibers having steric crimps at a specified blending portion as in the invention, a portion in which the fibers are folded back as described above is partially caused to form a dense layer (Bo), although the reason has not yet been apparent.

Then, fibers are aligned for deciding the pile height and, finally, for providing an appropriate hardness, a backing treatment is conducted to the back side of the base to complete the process.

The fiber length and the number of crimps of the staple fibers having the steric crimps, the fineness of the staple fibers other than the sterically crimped fibers and the gross pile weight of the base give an effect on the control of the height of the dense layer (Bo) in the sliver-knit material of the invention. Further, control as described is also affected by the depth of inserting the polishing blade. As the insertion depth is decreased, since the height for the flex point of the staple fibers displaces upwardly, the denseness of the dense layer (Bo) decreased while the height increases.

On the other hand, the height of the dense layer (Bo) tends to be lower when it is formed with coiled crimp stuffing of shorter length. Further, the degree of denseness for the dense layer (Bo) increases as the number of crimps of steric crimps used is larger. That is, degree of entanglement between each of the fibers increases by the polishing operation. However, as the fiber length is shortened, the number of sheds increases relatively, sometimes tending to be detached. Further, when staple fibers having a fineness larger than the that of the staple fibers having steric crimps are mixed, since this exerts so as to inhibit the folded back of the staple fiber having steric crimps, either the bilayer structure is not formed or the ratio for the height between the dense layer (Bo) and the bulky layer (Su) is decreased. Further, in a case where the gross pile weight of the base is made excessively high for making the finished pile higher, the bilayer structure cannot be formed even by applying polishing, or the ratio of the height between the dense layer (Bo) and the bulky layer (Su) becomes smaller. This is considered to be attributable to the fact that no sufficient space is ensured for the fold-back of the staple fiber having steric crimps in the polishing operation.

The present invention is now described more specifically with reference to the drawings.

FIG. 1 shows a sliver-knit material comprising 100% staple fibers having steric crimps as a schematic cross sectional view showing an example of the sliver-knit material according to the invention.

Staple fibers 1 having steric crimps are erected from the ground portion and each of the layers formed of a layer at a high fiber density and a layer at a low fiber density are present as a dense layer 2 (Bo) and a bulky layer 3 (Su) respectively.

It is important in the sliver-knit material according to the invention that the ratio of the height between the two layers [dense layer (Bo)]: [bulky layer (Su)] is from 2:5 to 1:1, and the ratio of mass of fibers present in the two layers respectively is preferably: [dense layer (Bo)]:[bulky layer (Su)] =3:2 to 5:2. For example, in a case where the mass ratio of the fibers is [dense layer (Bo)]:[bulky layer (Su)]=7:3, it may be estimated that about one out of four fibers in the dense layer (Bo) is bent.

In this bilayer structure of the sliver-knit material according to the invention, the dense layer (Bo) is not formed by the shrinkage of fibers. The fibers constituting a portion of the dense layer (Bo) are folded back so that the number of constituent fibers increases to provide a dense structure.

Figure 2:
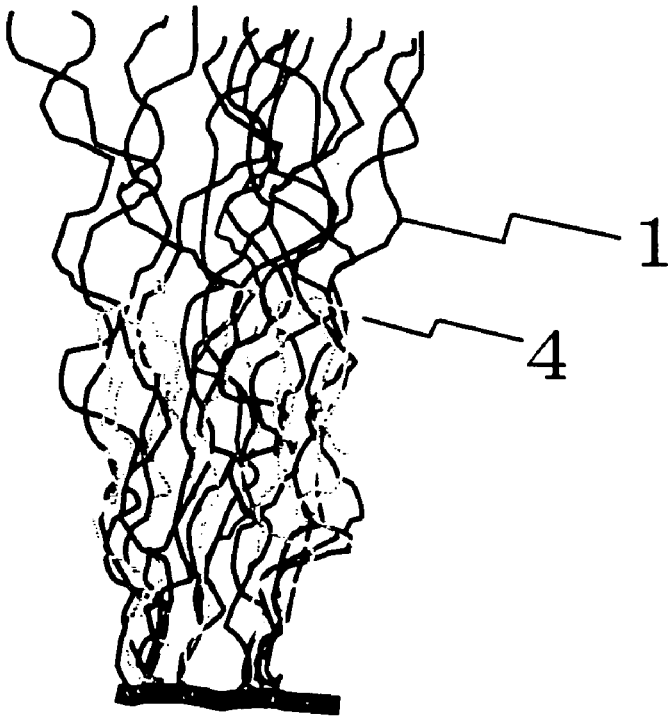
FIG. 2 is a macro schematic view of a pile portion in the sliver-knit material according to the invention.

FIG. 2 shows a macro schematic view of a pile portion (dense layer and bulky layer) in the sliver-knit material of the invention.

In the drawing, fibers 4 folded back at a ratio of one out of four (25%) to two out of five (40%) of the staple fibers constituting the pile threads are present.

The sliver-knit material according to the invention can be used particularly preferably as a skin material for paint rollers, and the paint roller can be obtained by coating the sliver-knit material over the paint-impermeable roller core. Paint rollers obtained as described above can be used to various applications such as inner and outer walls of buildings, etc.

Since the sliver-knit material of the invention suffers less from buckling fatigue, deformation during compression and improved with shedding, it can be used to applications than the paint roller described above. For example, it can be used for interior mats, floor coverings, pet beds, antidecubitus sheet cushions and polishing substrates.

EXAMPLES

The present invention is described more specifically by way of examples but the invention is no way limited to the examples. Physical property values in the examples are measured by the following methods.

(1) Measurement for the Number of Crimps

Measured according to JIS L1015, incorporated herein by reference.

(2) Height of Dense Layer (Bo)

For the paint roller product, the cross section of a core was approximated to that of a true circle as close as possible. Then, it was cut to a cylindrical shape of 1 cm height to expose the cross section of the sliver-knit material. Then, a photograph enlarged by 50× was taken and the height for the dense layer (Bo) on a straight line passing the center of the cylinder was measured by using a scale.

Figure 3:
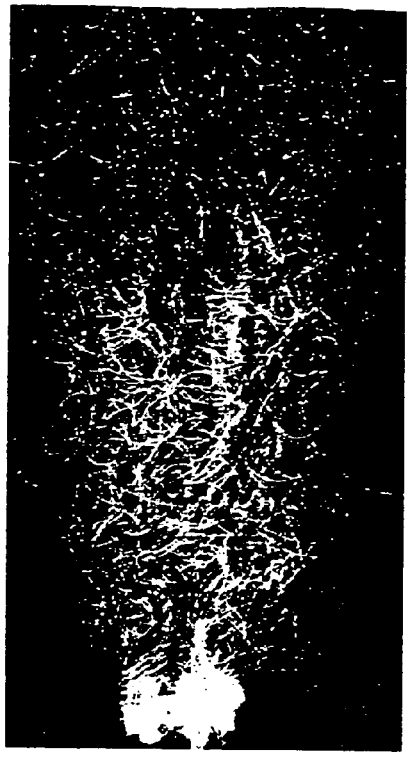
FIG. 3 is a macro photograph of a specimen in which one loop of a base portion is taken out of the sliver-knit material according to the invention.

On the other hand, in the case of using the base as a specimen, the base was cut into 1 cm width from the rearface along the wale direction by using a cutter to prepare specimen of 3 cm length (refer to FIG. 3). It was photographed in the same manner as described above and the height for the dense layer (Bo) was measured by using a scale.

(3) Ratio of the Mass of Fibers Between Dense Layer (Bo) and Bulky Layer (Su)

For the specimen (2) above, the dense layer (Bo) and the bulky layer (Su) were cut be separated respectively and the mass thereof were measured respectively.

(4) Re-Confirmation of Dense Layer (Bo)

Figure 4:
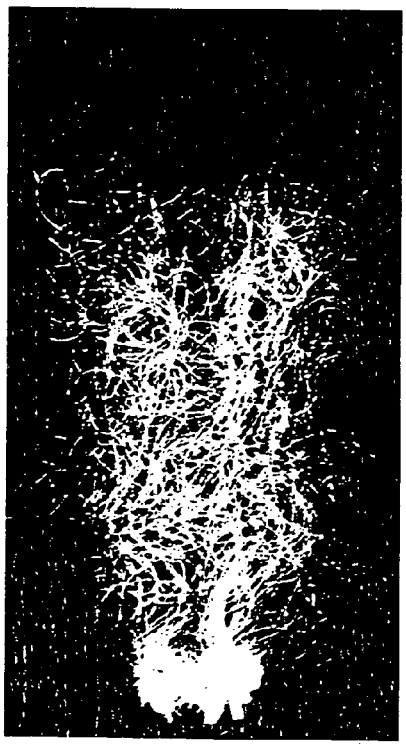
FIG. 4 is a macro photograph of a specimen (dense layer) prepared by taking one loop of the base portion from the sliver-knit material according to the invention and cutting the pile threads in the bulky layer.
Figure 5:
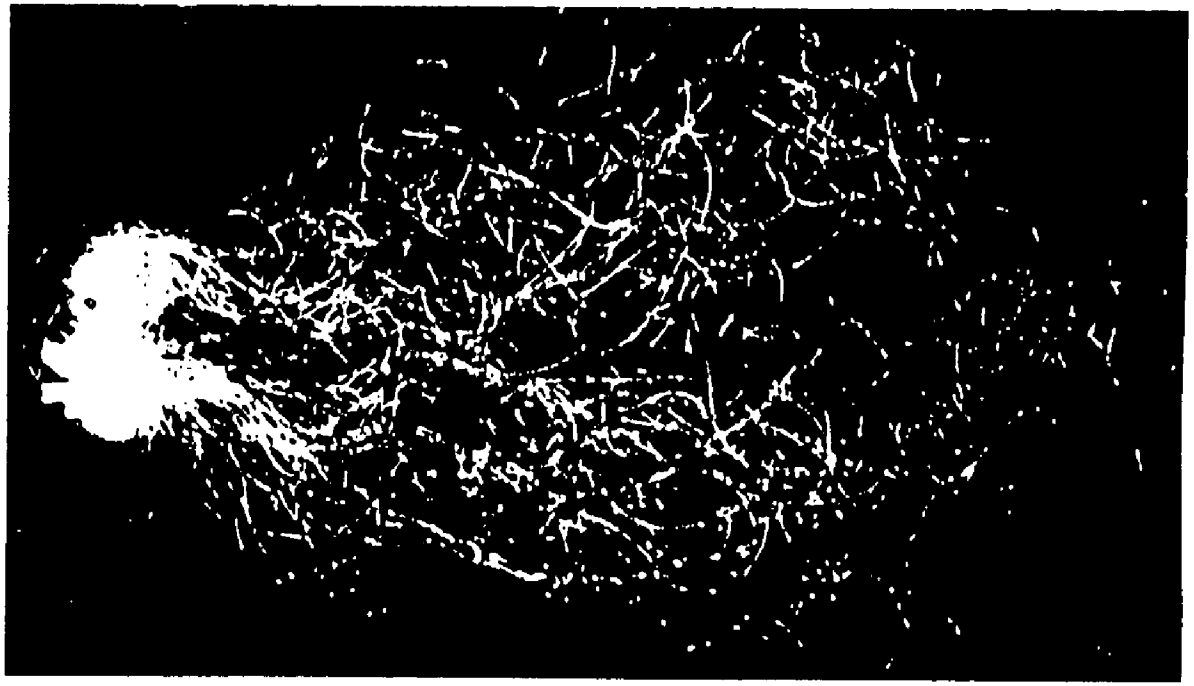
FIG. 5 is a macro photograph of the state of disintegrating the entanglement of staple fibers in a specimen (dense layer) obtained by taking one loop of the base of the sliver-knit material and cutting pile threads in a bulky layer.

The bulky layer (Su) was cut off from the cylindrical specimen sampled in (2) above into a state consisting only of the dense layer (Bo) (refer to FIG. 4). Then, entanglement of the constituent fibers in the portion of the dense layer was disentangled using a needle so as not to extend crimps of the constituent fibers (refer to FIG. 5). It was confirmed that the height was from 1.1 to 1.6 times that of the dense layer (Bo).

(5) Confirmation of Staple Fibers Having Steric Crimps

The specimen as shown in FIG. 3 was prepared, the ground portion was cut off and the entire mass was measured. Then, staple fibers having steric crimps and staple fibers having other crimp shapes than described above were-separated to calculate the mass ratio of the staple fibers having steric crimps.

(6) Coating Performance (Paint Holding Amount, Paint Releasing Amount, Shedding Resistance and Coating Quality)

Paint Holding Amount:

The dry mass of a main body (roller and handle) the prepared paint roller was measured and determined as (A) (g). Then, an environmentally-friendly thick coating (Nippon Paint's Fine Urethane V100, manufactured by Nippon Paint Co.) was incorporated till saturation, lightly wrung on a spreader screen till dripping ceased, and the mass was measured again which was determined as (B) (g). The paint holding amount (C) was determined according to the formula 1:

$$\text{Paint holding amount } (C)(g)=(B)-(A) \qquad \text{formula (1)}$$

Paint Releasing Amount:

The paint roller slightly wrung till the dripping ceased was used and reciprocated for 100 cycles on coated paper (90×180 cm) to apply coating, and the mass (D) (g) of the paint roller after coating was measured to determine the paint releasing amount (E) (g) by the following formula 2. The coating material was not added during coating for 100 cycles.

$$\text{Paint releasing amount } (E)(g)=(C)-(D) \qquad \text{formula (2)}$$

Resistance to Shedding I:

Number of fluffs deposited on the coated paper was evaluated by the standards described below.

Resistance to Shedding II:

Roller was reciprocated on the surface of a two-sided tape (manufactured by Sekisui Co.) for 100 reciprocation in a state not incorporating coatings and the state of fluffs deposited on the tape was evaluated by the standards described below.

Evaluation for resistance to shedding

○○: no shedding at all

○: shedding present but not conspicuous

Δ: somewhat conspicuous x: remarkably conspicuous

Coating Quality:

It was evaluated whether smooth coated surface was formed or not with no roller marks or traces like those formed after sweeping by broom on coated paper.

(7) Measurement of the Extension Ratio of Crimps

After taking up filament by a filature till 5500 dtex of test skeins was obtained, a weight of 10 g was suspended at the center of the lower end of the skein, the skein was fixed at the upper portion and a heat treatment was conducted at a temperature of 90° C. for 30 min in a state of applying a load of 0.009 cN/dtex. Then, it was left at a room temperature with no load, dried and then applied again with a load of 10 g, and left for 5 min. Then, the thread length was measured which was determined as $L_1$ (mm). Then, a load of 1 kg was applied and left as it was for 30 sec. Then the thread length was measured and designed as $L_2$ (mm). The crimp extension ratio was determined according to the following formula:

$$\text{Crimp extension ratio } (\%)=\{(L_2-L_1)/L_2\}\times 100$$

Example 1

(1) Preparation of Fibers

Side-by-side type composite fibers were prepared from PET chips having an intrinsic viscosity (η) of 0.72 and 0.50 at a mass ratio of 1:1 by using a spinning nozzle for spinning side-by-side type composite fibers in accordance with a customary method, and then applying a treatment at a dry heating of 150° C. for 10 min to obtain staple fibers having a fineness of 6.6 dtex, a fiber length of 51 mm and having coiled crimps. The number of crimps of the obtained staple fibers was 10 N/25 mm.

(2) Preparation of Knitted Fabric

Using 100 mass % of the staple fibers prepared as described above, card slivers with a sliver weight of 20 g/m were obtained, which were supplied as pile threads to a 14 gauge sliver knitting machine to obtain a knitted fabric with a gross pile weight of 827 g/m$^2$.

Polishing was carried out four times to the prepared sliver-knit material while adjusting the height of the blade to a depth of the blade about 2 mm above a level in contact with the ground portion and then operation was carried out in the order of a dry heat treatment at a hot blow setting temperature of 150° C. of backing with the acrylic resin from the rear side, brushing the surface and then aligning the threads to obtain a sliver-knit material with a 18 mm pile height.

(3) Manufacture of Paint Roller

The sliver-knit material prepared as described above was slit to 50 mm width, and wound spirally around a core material made of polypropylene with an outer diameter of 38 mm to obtain a both-bearing type paint roller.

When the staple fibers were sampled from the obtained paint roller and measured, the number of crimps was 13 N/25 mm, the height of the dense layer was 8 mm, and the mass ratio of the fibers between the dense layer (Bo) and bulky layer (Su) was 70:30. Further, it could be confirmed using macro photograph that a portion of the fibers present in the dense layer (Bo) was folded back the fused portions between each of the fibers were not present in the pile threads forming the dense layer (Bo) and the bulky layer (Su). Table 1 shows the result.

Example 2

(1) Preparation of Fibers

By using as a sheath ingredient, a polymer copolymerized from an acidic ingredient formed by mixing terephthalic acid and isophthalic acid at 70/30 (mol %) and 1,4-butanediol was used and as a core ingredient, PET chips having an intrinsic viscosity [η] of 0.72 eccentric core/sheath fusible staple fibers having a fineness of 6.6 dtex and a fiber length of 51 mm were prepared at a mass ratio of 1:1 between them in accordance with a customary method. The obtained staple fibers had coiled crimps and the number of crimps was 18 N/25 mm after a treatment at dry heating of 150° C. for 10 min.

Then, homogeneous fibers were prepared from PET chips having an intrinsic viscosity [η] of 0.72 by using a spinning nozzle for spinning homogeneous fibers of a circular cross section in accordance with a customary method to obtain staple fibers having mechanical crimps with a fineness of 6.6 dtex and a fiber length of 51 mm. The number of crimps of the staple fibers treated under dry-heat condition at 150° C. for 10 min was 12 N/25 mm.

(2) Preparation of Knitted Material

Staple fibers of the coiled crimped shape and staple fibers having mechanical crimps obtained as described above were mixed at a blending ratio of 40 mass % and 60 mass % respectively to obtain card slivers having a sliver weight of 20 g/m, which were supplied as pie threads to a 14 gauge sliver-knitting machine to obtain knitted fabric having a gross pile weight of 800 g/m$^2$.

Then, the same operation as in Example 1 was applied to obtain a knitted fabric with a pile height of 15 mm.

(3) Manufacture of Paint Roller

Using the sliver-knit material thus prepared, a paint roller was manufactured in the same manner as in Example 1. As a result of measuring the specimen sampled from the product, the height for the dense layer was 6 mm. Further, the mass ratio for the fibers between the dense layer (Bo) and the bulky layer (Su) was 65:35. Further, it could be confirmed using macro photograph that a portion of fibers present in the dense layer (Bo) was present being folded back and that fused portions between each of the fibers were not present in the pile threads forming the dense layer (Bo) and the bulky layer (Su) (Table 1).

Example 3

(1) Preparation of Knitted Material 60 mass % of staple fibers having coiled crimps used in Example 1 and each 20 mass % of eccentric core/sheath type staple fibers and staple fibers having mechanical crimps used in Example 2 were used and mixed to obtain card slivers having a sliver weight of 22 g/m, and they were supplied as pile threads to a 14 gauge sliver-knitting machine to obtain a knitted material having a gross pile weight of 853 g/m$^2$.

Polishing was applied repetitively by four times to the thus obtained sliver-knitted material while controlling the blade height to about 2 mm depth above a level where the blade was in contact with a ground portion and then operation was carried out backing with the acrylic resin on the bottom by a dry heat treatment at a setting temperature for hot blow of 180° C., brushing the surface and then aligning the threads to obtain a sliver-knitted material with a pile height of 18 mm in this order.

(2) Manufacture of Paint Roller

Using the sliver-knit material thus prepared, a paint roller was manufactured in the same manner as in Example 1. As a result of measuring the specimen sampled from the product, the height for the dense layer was 8 mm. Further, the mass ratio for the fibers between the dense layer (Bo) and the bulky layer (Su) was 70:30. Further, it could be confirmed using macro photograph that a portion of fibers present in the dense layer (Bo) was present being folded back and that fused portions between each of the fibers were present only in the pile threads forming the dense layer (Bo)(Table 1).

Comparative Example 1

In Example 2, a sliver-knit material with a pile height of 21 mm was obtained in the same manner as in Example 2 except for changing the gross pile weight to 1093 g/m$^2$ and a paint roller was manufactured by using the same (Table 1).

Comparative Example 2

A paint roller was manufactured in the same manner as in Example 2 except for changing the pile height to 8 mm in the aligning step (Table 1).

Comparative Example 3

A sliver-knit material was prepared in the same manner as in Example 2 except for changing the blending ratio between staple fibers having coiled crimps and staple fibers having mechanical crimps to 20:80 and a paint roller was manufactured by using the same.

In the obtained sliver-knit material, no dense layer (Bo) was formed and the sliver-crimped material had a uniform fiber density (Table 1).

Comparative Example 4

A sliver-material with a pile height of 15 mm was prepared in the same manner as in Example 2 except for controlling the polishing to a depth above 5 mm from the bottom. A paint roller was manufactured by using the material in the same manner as in Example 1. The height of the dense layer was 10 mm and the mass ratio of fibers between the dense layer (Bo) and the bulky layer (Su) was 60:40 in the obtained sliver-knit material (Table 1).

Comparative Example 5

A sliver-knitted material with a pile height of 15 mm was prepared in the same manner as in Example 1 except for changing the cut length of staple fibers having coiled crimps to 28 mm. A paint roller was obtained in the same manner from the material.

The height of the dense layer was 3 mm and the mass ratio of fibers between the dense layer (Bo) and the bulky layer (Su) was 52:48 in the obtained sliver-knit material (Table 1).

Comparative Example 6

(1) Preparation of Fibers

Heat fusible cores/sheath type composite spinning multifilament yarns of 155 dtex/48 filaments were prepared by using polyethylene terephthalate (intrinsic viscosity=0.68 when measured at 30° C. in a equi-mass solvent mixture of phenol/tetrachloro ethane) as a core ingredient and an ethylene-vinyl alcohol copolymer (ethylene content of 40 mol %, melt index (MI)=10 when measured at a temperature of 190° C. under a load of 2160 g) as a sheath ingredient, composite spinning at a ratio of core ingredient:sheath ingredient=1:1 (mass ratio), and then stretching them. The thus obtained core/sheath type composite spinning multifilament yarns were subjected to false twisting by the number of false twists of 2570 T/M, at a temperature for a first stage heater of 120° C. and at a temperature for a second stage heater of 135° C. to prepare textured yarns. When the crimp elongation ratio of the thus obtained false twisting textured yarn was measured by the method described above, it was 8%. Further, the number of crimps of the obtained textured yarn after a heat treatment at 150° C. for 10 min was 21.5 N/25 mm.

(2) Preparation of Knitted Fabric

Three thread of textured yarns with the crimp elongation ratio of 8% thus obtained (fusible crimped fibers) were aligned and used as pile thread and regular polyester textured yarns (330 dtex) was used for threads for the ground structure to obtain moquette substrate cloth with a unitary weight of 530 g/m$^2$ and a pile height of 16 mm. A hot blow treatment at 190° C. for 3 min was applied from the bottom of the obtained moquette substrate fabric was applied to obtain a substrate fabric with the dense layer of about 7 mm.

In the dense layer (Bo) of the obtained substrate fabric, fusible crimped fibers were fused to each other and fused portions were confirmed also to a portion of the bulky layer (Su).

(3) Manufacture of Paint Roller

A paint roller was manufactured in the same manner as in Example 1 by using the obtained moquette material. As a result of measuring a specimen sampled from the product, the fiber mass ratio between the dense layer (Bo) and the bulky layer (Su) was 70:30 (Table 1).

TABLE 1

| | Example 1 | Example 2 | Example 3 | Comp. Example 1 | Comp. Example 2 | Comp. Example 3 | Comp. Example 4 | Comp. Example 5 | Comp. Example 6 |
|---|---|---|---|---|---|---|---|---|---|
| Height of pile | 18 mm | 15 mm | 18 mm | 21 mm | 8 mm | 15 mm | 15 mm | 15 mm | 16 mm |
| Height of dense layer (Bo) | 8 mm | 6 mm | 8 mm | 4 mm | 6 mm | not formed | 10 mm | 3 mm | 7 mm |
| Height ratio between dense layer and bulky layer (Bo/Su) | 0.80 | 0.67 | 0.80 | 0.23 | 3.0 | 0 | 2.0 | 0.25 | 0.78 |
| Fiber mass ratio between dense layer and bulky layer (Bo/Su) | 70/30 | 65/35 | 70/30 | 45/55 | 84/16 | — | 60/40 | 52/48 | 70/30 |
| Coating quality | good (smooth) | good (smooth) | good (smooth) | good (smooth) | trace like that formed after sweeping by broom | good (smooth) | with roller marks | good (smooth) | good (smooth) |
| Resistance to shedding I | ○○ | ○○ | ○○ | x | Δ | x | ○ | x | ○○ |
| Resistance to shedding II | ○ | ○ | ○ | x | x | x | ○ | x | ○○ |
| Paint holding amount (g) | 344 | 325 | 340 | 361 | 178 | 351 | 299 | 304 | 205 |
| Paint releasing amount (g) | 222 | 207 | 210 | 218 | 117 | 218 | 190 | 198 | 131 |

From the result of Table 1, the paint rollers obtained in Example 1 and 2 could satisfy the coating performance also in a case of using environmentally-friendly thick coatings and shedding was improved greatly.

On the other hand, Comparative Example 1 of a large pile height satisfied paint holdability and releasability which shedding was greatly inferior in the shedding. Further, in Comparative Example 2 of small pile height, the paint holdability and releasability were insufficient and, in addition, shedding was poor and traces like that after sweeping by a broom was observed on the painted surface. Further, resistance to shedding was insufficient in Comparative Example 3. In Comparative Example 4 of large height for the dense layer (Bo), the paint content was small and, further, roller marks were formed.

Comparative Example 5 formed by shortening the cut length of the staple fibers resulted in products with remarkable occurrence of sheds.

Further, in the Comparative Example 6, since the dense layer (Bo) was fused, it resulted in substrate fabric with low permeability of thick coatings and low paint holding amount.

This application claims the benefit of the filing date of Japanese patent application serial No. JP2003-349131, filed on Oct. 8, 2003, and incorporated herein by reference in its entirety.

What is claimed is:

1. A sliver-knit material in which a pile thread contains 30% or more of staple fibers having steric crimps, and a dense layer and a bulky layer on the side of the upper layer in contact with the dense layer, wherein the ratio of height between the dense layer and the bulky layer is from 2:5 to 1:1, and at least a portion of fibers in the dense layer are folded back.

2. A sliver-knit material according to claim 1, wherein fused portions between each of the fibers are not substantially present in the pile threads constituting the sliver-knit material.

3. A sliver-knit material according to claim 1, wherein the pile height is from 10 to 18 mm and the height of the dense layer is from 5 to 9 mm.

4. A sliver-knit material according to claim 1, wherein the ratio between the fiber mass in the dense layer and the fiber mass in the bulky layer is from 2:3 to 5:2.

5. A sliver-knit material according to claim 1, which is made into a paint roller cover.

6. A sliver-knit material according to claim 1, wherein the pile height is 10 to 18 mm.

7. A sliver-knit material according to claim 1, wherein the pile height is 13 to 16 mm.

8. A sliver-knit material according to claim 1, wherein the dense layer has a height from the base of 5 to 9 mm.

9. A sliver-knit material according to claim 1, wherein the dense layer has a height from the base of 7 to 8 mm.

10. A sliver-knit material according to claim 1, which contains at least 50% by mass of said staple fibers.

11. A sliver-knit material according to claim 1, which contains at least 70% by mass of said staple fibers.

12. A sliver-knit material according to claim 1, wherein the height of the folded back fibers present in the dense layer, when they are erected substantially vertically so as not to extend the crimps, is about 1.1 to 1.6 times that of the dense layer.

13. A sliver-knit material according to claim 1, wherein the staple fibers are composed of at least one polymer.

14. A sliver-knit material according to claim 1, wherein the staple fibers are composed of at least one polyester polymer.

15. A sliver-knit material according to claim 1, wherein the staple fibers are composed of at least one polymer selected from the group consisting of polyethylene terephthalate, polypropylene terephthalate and ethylene-vinyl alcohol copolymer.

16. A method of producing the sliver-knit material according to claim 1, comprising:

providing a sliver containing staple fibers having steric crimps at a ratio of 30 mass % or more as pile threads to produce a base, aligning the fibers at the desired pile height, and subjecting the backside of the base to a backing treatment.

17. The method of claim 16, further comprising between the providing and the aligning, polishing the surface of the base.

18. A method of painting, comprising applying paint to the sliver-knit material according to claim 1 and then transferring the paint from the sliver-knit material to a surface.

* * * * *

UNITED STATES PATENT AND TRADEMARK OFFICE

CERTIFICATE OF CORRECTION

PATENT NO. : 6,993,941 B2
DATED : February 7, 2006
INVENTOR(S) : Yamaguchi

It is certified that error appears in the above-identified patent and that said Letters Patent is hereby corrected as shown below:

Title page, Item [54] and Column 1, line 1,
Title, should read -- SLIVER-KNIT MATERIAL --.

Signed and Sealed this

Eighteenth Day of April, 2006

JON W. DUDAS
*Director of the United States Patent and Trademark Office*